United States Patent [19]

Downey

[11] 4,361,966

[45] Dec. 7, 1982

[54] PORTABLE HAIR DRYER

[76] Inventor: John H. Downey, 5 Lofty Hillway, Willowdale, Ontario, Canada

[21] Appl. No.: 220,316

[22] Filed: Dec. 29, 1980

[51] Int. Cl.[3] ..... A45D 20/18

[52] U.S. Cl. ..... 34/99; 34/91

[58] Field of Search ..... 34/99, 100, 91; 132/9

[56] References Cited

U.S. PATENT DOCUMENTS 3,600,821 8/1971 Simon, Jr. ..... 34/99
3,650,041 3/1972 Strzelczyk ..... 34/99

FOREIGN PATENT DOCUMENTS 886640 11/1971 Canada .
886641 11/1971 Canada .

*Primary Examiner*—Larry I. Schwartz

[57] ABSTRACT

A lightweight, compact hair dryer is provided having a rigid case to contain a blower-heater arrangement for the provision of hot air, a collapsible hood structure having a structural support connected to the case in supported relation thereby, the case having an extensible stand portion for attachment of the hood in supported relation therewith, the hood support comprising a flexible band which can be rolled into a roll for storage within the box, and in the open condition when attached to the stand portion providing a free standing support portion of the hood structure. The hood further includes air inflatable bag means extending from the hood band to partially enclose the head of a user when in use, the walls of the bag having apertures located to direct hot air in drying relation with the user's head, provided from a hose connection to the blower heater. The arrangement combines the functional characteristics of prior art portable arrangements with the structural and functional characteristics of prior art salon-type rigid hood arrangements.

7 Claims, 7 Drawing Figures

FIG. 5.
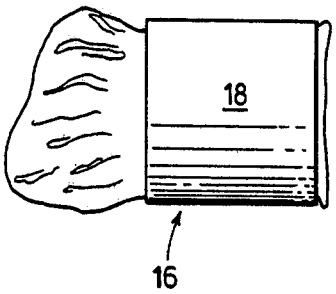
FIG. 6.
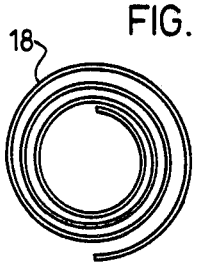
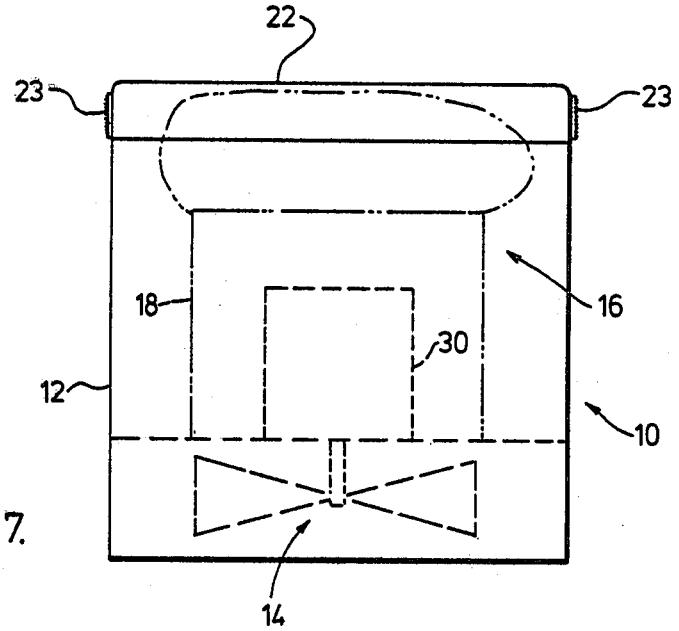
FIG. 7.

PORTABLE HAIR DRYER

BACKGROUND OF THE INVENTION

This invention is directed to a hair dryer and in particular to a portable light-weight dryer having a hood portion which may be readily packed within the case of the dryer.

The hair dryer art is old and well developed ranging from salon-type rigid hoods with rigid support arrangements, to portable arrangements having soft hoods of a bonnet or shower cap style wherein a flexible hose provides hot air within the hood to inflate the hood and simultaneously dry the hair.

Canadian Pat. No. 886,641 issued Nov. 23rd, 1971 in the name of W. E. Sparks shows a portable arrangement having a support structure upstanding from the carrying case, and an inverted flower pot style of hood including an annular combination of air channels to support the hood structure with air pressure, when inflated. Canadian Pat. No. 886,640 of even date thereto, by A. E. Simm et al has many constructional characteristics in common with the Sparks arrangement.

Both the aforementioned types of portable hair dryer suffer from drawbacks in the manner of venting the enclosure in the hair drying cycle, and the blower capacity necessary to pressurize the hood for support purposes as well as for effecting the drying function.

SUMMARY OF THE INVENTION

The hair dryer according to the present invention provides a fully portable, lightweight dryer in which the hood is physically supported substantially by a structure extending from the dryer casing, yet being collapsible for rolling into a very small compass, for containment in the carrying case.

In addition to a rollable support band, the hood has air bags serving to enclose selected zones of the head of the user and to convey hot air in drying relation thereto, yet operating at a comparatively low pressure, in view of the diminished support function of the air bags, because of the support function primarily provided by the support band.

The present invention thus provides a portable hair dryer having a hood structure comprising; a flexible band to provide arcuate cantilevered structure; fastening means for securing the band to a support structure to form an enclosure to receive the head of a user therein when in use; air inflatable shaped bag means secured to the band having first portions of the bag means extending downwardly from the band; forming side flaps, and second portions extending upwardly from the band to at least partially cover the top of the head of a user, and air hose supply connection connected to the bag for the passage of heated air into the interior of the bag means, and air blowing apertures perforating inner wall portions of the bag to direct the heated air when in use in blowing relation against the hair of a user.

In one embodiment the noted first and second bag portions are spaced apart to form an opening for purposes of ventilating the back-of-the-head and the crown area of the scalp of a user.

The noted fastening means for the band are secured to the ends thereof, for fastening the band ends to the support structure in secured relation therewith. The band fastening means permit attachment of the band in selective angled relation to the support structure, to achieve a desired inclined position of the hood by a user.

The hood support structure is a retracted member, part of the rigid casing of the dryer and extendable therefrom to extend upwards to a desired elevation, having fastening means to receive the ends of the band in secured relation thereto. It has been found that synthetic multi-hooked fasteners of the type known as Velcro TM are particularly suitable for the holding of the band in detachable and selectively adjustable secured relation with the casing attachment.

BRIEF DESCRIPTIONS OF THE DRAWINGS

Certain embodiments are described:

FIGS. 5 and 6 shows the subject hood in rolled condition, and

FIG. 7 shows the dryer in packed condition for travelling.

DESCRIPTION OF THE EMBODIMENTS

Figure 1:
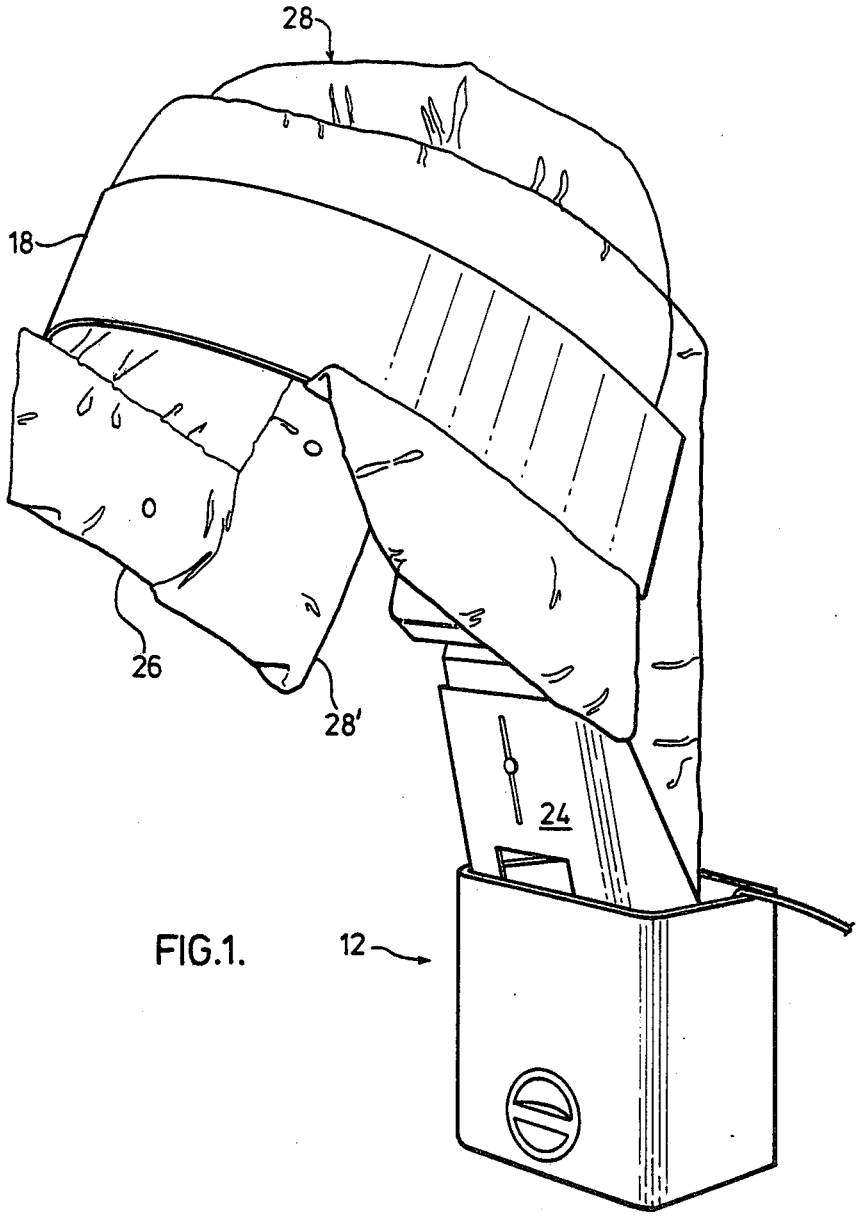
FIG. 1 is a general view of the portable hair dryer in an erected, operable condition.
Figure 2:
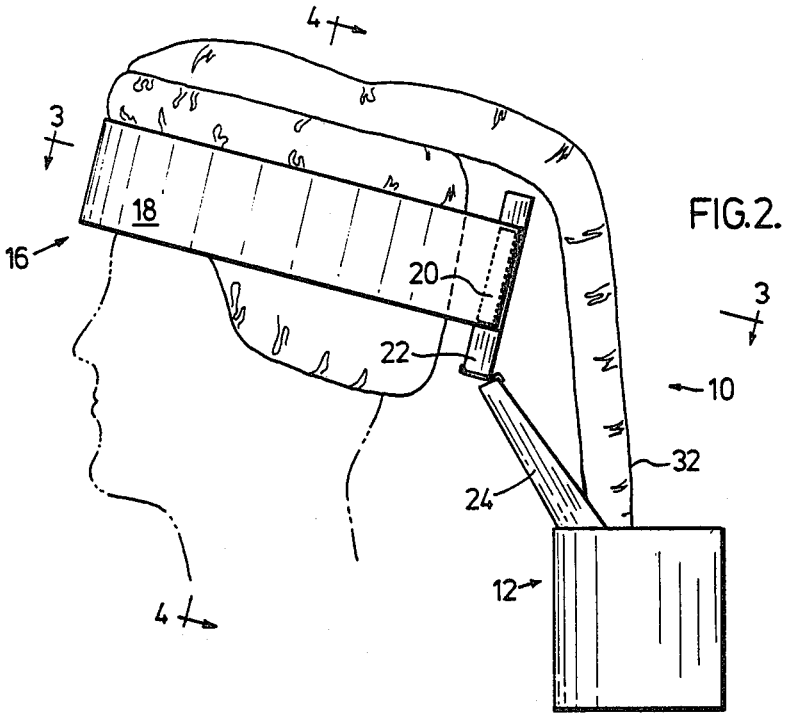
FIG. 2 is a schematic side elevation showing the hood structure and casing extension in assembled relation, related to a user.

Referring to FIGS. 1, 2 and 7, the dryer apparatus 10 comprises a rigid case 12 of impact plastic or other suitable material and containing an electric heater element and blower 14 and hood assembly 16.

The hood assembly 16 includes a band 18 each end 20 of which has a Velcro TM pad on the inner surface thereof.

The case 12 of the dryer has the lid 22 thereof hingedly mounted on an extension piece 24, permitting the lid 22 to be raised into the illustrated elevated and extended position of FIGS. 1 and 2. The lid 22 has Velcro TM patches 23 adhered to the sides thereof, to which the ends 20 of band 18 are detachably secured.

Figure 3:
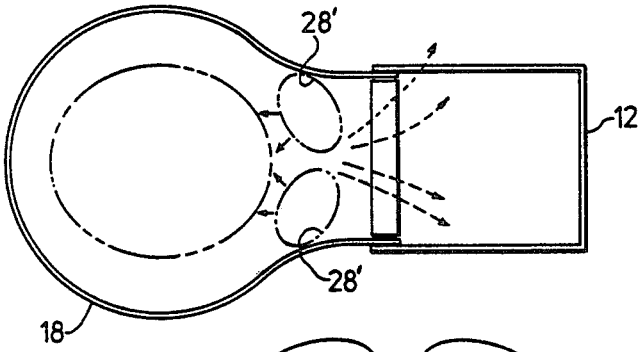
FIG. 3 is a schematic plan sectional view taken at section 3—3 of FIG. 2.

The hood 16 is provided with the first lower air bag means 26 depending therefrom as side flaps having air blowing apertures 27 located in the inner surfaces of the air bag means, to blow air in directed relation to the band 18 and the head of a user, as illustrated. Second air bag portions 28 extending upwardly from the band 18 form a top to the hood, having air blowing apertures 27 to dry hair and ventilate the hood. Referring to FIG. 3 it will be seen that the vertical bag portion $28^1$ provide an opening therebetween to ventilate the hood.

Referring to FIGS. 5, 6 and 7, these show the hood 16 having the band 18 in spiral rolled condition, having the air bag portions in deflated relation therewith, being shown in FIG. 7 with the rolled hood 16 mounted upon the motor 30.

A flexible hose 32 connects the air supply from the case 12 to the hood 16.

Figure 4:
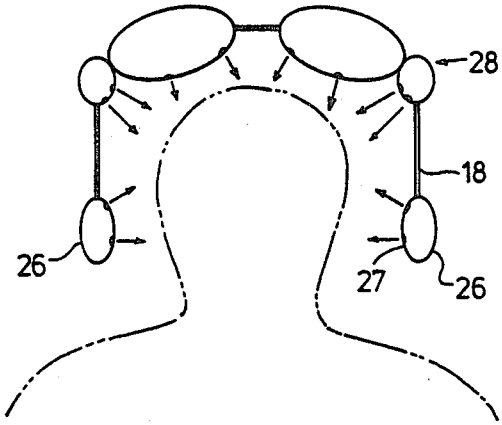
FIG. 4 is a schematic sectional elevation taken at section 4—4 of FIG. 2.

Owing to the structural support system for the hood 16 the air blowing requirements are minimized, as the air bag means 26, 28, $28^1$ do not carry any structural loads of any significance thus permitting the use of relatively small section air bags, as shown in-part in FIG. 4, which also illustrates schematically the directional blowing provisions of some of the air outlets within the hood. This in turn leads to less ballooning and a smaller hood structure which further facilitates storage within the small, portable case as illustrated.

One successful embodiment utilised a band 18, of stiff PVC having a semi-rigid characteristic with a width of three inches, length of about thirty six inches and a thickness of twenty thousanths of an inch. Alternative band embodiments are contemplated, to provide the desired cantilever support characteristics.

What I claim by Letters Patent of the United States is:

1. In a portable hair dryer, hood structure comprising; air inflatable shaped bag means arranged to receive the head of a user in partially enclosed relation therein when in use; air blowing apertures perforating selected inner wall portions of the bag means, to direct air therefrom, when in use in blowing relation against the hair of a user; a flexible cantilever support band attached to the bag means in supporting relation forming an intergral part of the hood structure and having sufficient width to provide arcuate cantilevered support to the bag means; first portions of said bag means secured to the band extending in downward depending supported relation therefrom as a profiled skirt and second portions of said bag means extending upwardly from the band in supported relation therefrom to provide an air supported structure of sufficient depth to at least partially enclose the top portion of said users head, releasable fastening means for securing the band in adjustable forwardly extending relation from a hood support structure to permit tilt adjustment of the hood relative to said rearwardly located support structure; to an air supply connection connected to the bag means for the passage of heated air into the bag means at a pressure sufficient to support said second bag portions.

2. Hood structure as claimed in claim 1, said first and second bag portions forming an opening for purposes of ventilating the back-of-the-head and the crown area of the scalp of a user.

3. Hood structure as claimed in claim 1, said fastening means being secured to the ends of said band, for fastening said ends to said support structure in second relation therewith.

4. Hood structure as claimed in claim 3, said fastening means permitting attachment of said band in selective angled relation, relative to said support structure to achieve a predetermined inclined position of the hood by a user.

5. Hood structure as claimed in claim 4, wherein said fastening means is of Velcro TM synthetic hooked fastener material.

6. The apparatus of claim 1, said dryer having a rigid case, an extensible portion of the case providing said support structure, having fastening means complementary to said band fastening means, for supporting said band in stable projecting looped relation from said case.

7. A portable hair dryer having a small band portable rigid case with a removeable lid portion; substantially rigid means located within the case and extensible therefrom to provide an upwardly extending support structure, inflatable hood structure, having a flexible band forming an integral wall portion of said hood structure, being of sufficient width to serves as a cantilevered looped support structure having the ends of the band secured, including fastening means for attaching the band in removeable secured adjustable oriented relation to the support structure, air inflatable hollow bag means secured to the band and having a first bag portion extending in air inflation supported relation downwardly therefrom and a second bag portion extending upwardly in air inflation supported relation from the band in spaced cooperating relation to from a hood for partially enclosing an upper portion of the head of a user, air blowing apertures perforating inner wall portions of the bag means to discharge air against the head of a wearer, when in use including apertures venting air beneath said band and heater means connected in air transfer relation with the bag means to provide heated air to inflate the bag means and to exit in drying relation from the air blowing apertures.

* * * * *